US009803495B2

(12) United States Patent
Scothern

(10) Patent No.: US 9,803,495 B2
(45) Date of Patent: Oct. 31, 2017

(54) ASSEMBLY

(71) Applicant: ROLLS-ROYCE PLC, London (GB)

(72) Inventor: David Peter Scothern, Derby (GB)

(73) Assignee: ROLLS-ROYCE plc, London (GB)

( * ) Notice: Subject to any disclaimer, the term of this patent is extended or adjusted under 35 U.S.C. 154(b) by 267 days.

(21) Appl. No.: 14/708,956

(22) Filed: May 11, 2015

(65) Prior Publication Data

US 2015/0354395 A1 Dec. 10, 2015

(30) Foreign Application Priority Data

Jun. 10, 2014 (GB) ..... 1410264.4

(51) Int. Cl.

| | |
|---|---|
| ***F01D 5/02*** | (2006.01) |
| ***F01D 11/12*** | (2006.01) |
| ***F01D 5/20*** | (2006.01) |
| ***F01D 11/08*** | (2006.01) |

(52) U.S. Cl.

CPC ..... *F01D 11/122* (2013.01); *F01D 5/02* (2013.01); *F01D 5/20* (2013.01); *F01D 11/08* (2013.01); *F05D 2220/32* (2013.01); *F05D 2250/292* (2013.01)

(58) Field of Classification Search

CPC ... F01D 5/02; F01D 5/20; F01D 11/08; F01D 11/122; F05D 2220/32; F05D 2250/292

See application file for complete search history.

(56) References Cited

U.S. PATENT DOCUMENTS 4,339,227 A * 7/1982 Furst ..... F04D 29/669 415/173.1
4,957,411 A * 9/1990 Girault ..... F01D 5/20 415/173.4
5,456,576 A * 10/1995 Lyon ..... F01D 5/20 415/173.3

(Continued)

FOREIGN PATENT DOCUMENTS

EP 1 004 750 A2 5/2000
EP 1 101 947 A2 5/2001

(Continued)

OTHER PUBLICATIONS

Dec. 15, 2014 Search Report issued in British Application No. GB 1410264.4.

(Continued)

*Primary Examiner* — Igor Kershteyn
(74) *Attorney, Agent, or Firm* — Oliff PLC

(57) ABSTRACT

A bladed rotor assembly includes a bladed rotor and a rotor housing. The bladed rotor has a plurality of blades arranged in a circumferential array around an axis of rotation, and the rotor housing encircles the bladed rotor and has a radially inwardly facing surface. Each of the blades comprises a first, radially extending, edge, a second opposite, radially extending, edge, and a radially distal edge. The radially distal edge has a first end, a second end, and a center portion, with the first end adjoining the first, radially extending, edge, and the second end adjoining the second, radially extending, edge. A clearance between the radially distal edge and the radially inwardly facing surface is a first clearance at the first end, and decreases to a second clearance across the center portion.

9 Claims, 4 Drawing Sheets

(56) References Cited

U.S. PATENT DOCUMENTS

| | | | | | |
|---|---|---|---|---|---|
| 5,474,417 | A * | 12/1995 | Privett | F04D 29/526 | 415/173.1 |
| 5,791,871 | A * | 8/1998 | Sech | F01D 11/122 | 415/173.1 |
| 6,146,089 | A * | 11/2000 | Allen | F01D 11/12 | 415/173.4 |
| 6,602,050 | B1 * | 8/2003 | Scheurlen | F01D 11/08 | 415/173.1 |
| 7,494,319 | B1 * | 2/2009 | Liang | F01D 5/20 | 416/92 |
| 8,100,640 | B2 * | 1/2012 | Strock | F01D 11/122 | 415/173.4 |
| 2006/0245910 | A1 | 11/2006 | Buchal et al. | | |
| 2008/0213103 | A1 | 9/2008 | Miyakoda et al. | | |
| 2010/0329875 | A1 | 12/2010 | Kray et al. | | |
| 2012/0100000 | A1 * | 4/2012 | He | F01D 5/20 | 416/223 R |

FOREIGN PATENT DOCUMENTS

| | | | |
|---|---|---|---|
| EP | 1 717 419 | A1 | 11/2006 |
| EP | 2 444 592 | A1 | 4/2012 |
| JP | H08-4698 | A | 1/1996 |
| JP | H11-201092 | A | 7/1999 |

OTHER PUBLICATIONS

Oct. 30, 2015 Extended Search Report issued in European Patent Application No. 15167059.3.

* cited by examiner

ASSEMBLY

This disclosure claims the benefit of UK Patent Application No. GB 1410264.4, filed on 10 Jun. 2014, which is hereby incorporated herein in its entirety.

FIELD OF THE INVENTION

The present invention relates to a bladed rotor assembly and particularly, but not exclusively, to a bladed rotor assembly for a gas turbine engine.

BACKGROUND TO THE INVENTION

There are many applications of bladed rotor assemblies for generating pressure and creating flow in air handling systems. One example of such an application is a gas turbine engine.

A conventional gas turbine engine includes compressor and turbine stages, each of which is essentially an air handling system. When incorporated as part of a turbofan engine the initial compressor stage, or fan, becomes increasingly important to the overall efficiency of the engine.

In order to maximise the operating efficiency of the fan system it is desirable to minimise the clearance between the radial ends of the fan blades and the internal surface of the fan casing.

However, although setting a very small clearance will increase the efficiency of the fan system, such a small clearance can increase the probability of contact between the fan blade tip and the casing. This contact between fan blade tip and casing may occur either during transient conditions (i.e. gust loading) or during steady state operation, for example due to thermal growth resulting from extended high temperature operation.

Consequently, in conventional fan systems it is known to either set a minimum blade tip clearance that will ensure no blade tip to casing contact degrading initial performance but minimising further degradation through life, or alternatively to accommodate such contact by including an abradable lining portion within the fan casing resulting in good initial performance but relatively worse performance at high life. The effect on engine efficiency of these contrasting approaches is illustrated in FIG. 1.

In systems employing an abradable liner, the small blade tip clearance will initially provide good performance. However, the accumulation of rubbing damage to the abradable liner will produce radial steps corresponding to the leading and trailing edges of the fan blades. These steps will disrupt the airflow through the fan and reduce the efficiency of the fan system.

It is therefore desirable to be able to maximise the efficiency of the fan system without introducing radial steps in the abradable liner, which will disrupt the airflow through the fan system and reduce its efficiency.

STATEMENTS OF INVENTION

According to a first aspect of the present invention there is provided a bladed rotor assembly comprising:

- a bladed rotor having a plurality of blades arranged in a circumferential array around an axis of rotation; and
- a rotor housing encircling the bladed rotor, the housing having a radially inwardly facing surface;
- each of the blades comprising:
  - a first, radially extending, edge;
  - a second opposite, radially extending, edge; and

- a radially distal edge;
  - the radially distal edge having a first end, a second end, and a centre portion, the first end adjoining the first, radially extending, edge, and the second end adjoining the second, radially extending, edge;
  - wherein a clearance between the radially distal edge and the radially inwardly facing surface is a first clearance at the first end, and decreases to a second clearance across the centre portion.

The arrangement of a small second clearance across a central portion of the blade tip to housing interface flanked by a larger first clearance at the first end of this interface prevents surface contact between the blade tip and the housing at the first end.

An advantage of the configuration of the invention is that the larger clearance between the blade tip and the housing towards the first end ensures that the axial profile of the inwardly facing surface remains smooth and free of radial steps even where there has been blade tip to housing surface contact over the central portion. This step free profile ensures that the aerodynamic efficiency of the fan system is maintained despite any instance of blade tip rubbing on the housing.

Optionally, the clearance between the radially distal edge and the radially inwardly facing surface is the first clearance at the first end, and decreases to the second clearance across the centre portion and increases to a third clearance at the second end The arrangement of a small second clearance across a central portion of the blade tip to housing interface flanked by larger first and third clearances at the ends of this interface results in surface contact between the blade tip and the housing being confined to this central portion.

An advantage of this arrangement is that the larger clearance between the blade tip and the housing towards the first end and the second end ensures that the axial profile of the inwardly facing surface remains smooth and free of radial steps even where there has been blade tip to housing surface contact over the central portion. This step free profile ensures that the aerodynamic efficiency of the fan system is maintained despite any instance of blade tip rubbing on the housing.

Optionally, the transition from the first clearance to the second clearance is a monotonic decrease.

Optionally, the transition from the second clearance to the third clearance is a monotonic increase.

The degree of taper (i.e. the angle relative to the inwardly facing surface itself) and the length of the tapered portions are selected to provide a balance between providing sufficient sacrificial material to cope with rubbing between the blade and the housing whilst not resulting in a radial step, and providing a sufficient length of the inwardly facing surface to ensure an efficient fan blade tip clearance.

Optionally, the transition from the first clearance to the second clearance is a nonlinear decrease.

Optionally, the transition from the second clearance to the third clearance is a nonlinear increase.

The curvature and the length of the nonlinear tapered portions are selected to provide a balance between providing sufficient sacrificial material to cope with rubbing between the blade and the housing whilst not resulting in a radial step, and providing a sufficient length of the inwardly facing surface to ensure an efficient fan blade tip clearance.

In other arrangements, the radially distal edge of the fan blade may be configured with a combination of a linear tapered portion at one end and a nonlinear tapered portion at the other end.

The tapered profile at the ends of the radially distal edge can be selected to minimise any disruption to the airflow through the engine while maximising the proportion of the radially distal edge that can be provided with a small tip clearance.

Optionally, the radially distal edge is substantially lineal in a direction from the first end to the second end, and the radially inwardly facing surface is profiled in an axial direction.

In one arrangement of the invention, the variable tip clearance along the radially distal edge of the blade is achieved by profiling the inwardly facing surface of the rotor housing (i.e. the abradable fan track lining).

In this way, the contact between the blade tip and the housing merely results in the radially inwardly raised portion of the inwardly facing surface being abraded away. The profiled portions of the inwardly facing surface towards the first end and the second end ensure that the axial profile of the inwardly facing surface remains smooth and free of radial steps.

In one arrangement of the invention, the profiled portions at the leading and trailing ends of the inwardly facing surface (i.e. the transition between the first clearance and the second clearance, and the transition between the second clearance and the third clearance) are formed as linear tapered portions.

In one arrangement of the invention, the profiled portions at the leading and trailing ends of the inwardly facing surface (i.e. the transition between the first clearance and the second clearance, and the transition between the second clearance and the third clearance) are formed as nonlinear tapered portions.

Optionally, the radially inwardly facing surface is substantially lineal in an axial direction, and the radially distal edge is profiled in a direction from the first end to the second end.

In an alternative arrangement, the variable tip clearance along the radially distal edge of the blade is achieved by chamfering the leading and trailing ends of the radially distal edge of the blade.

By providing the radially distal edge of each of the fan blades with a convex profile, any rubbing contact between the radially distal edge of the blade and the radially inwardly facing surface of the abradable liner will occur over the central portion of the distal edge. The tapered profile at each end of the radially distal edge will remain clear of the abradable surface.

In the arrangement where the profiled portion is provided in the blade tip edge, it is the radially distal edge of the fan blade that is configured with linear tapered portions in the transition between the first clearance and the second clearance, and the transition between the second clearance and the third clearance.

Optionally, the radially inwardly facing surface is formed from an abradable material.

The use of an abradable material for the radially inwardly facing surface allows for contact between the radially distal edge and the inwardly facing surface without causing damage and possible geometrical distortion to either the fan blade or the rotor housing.

According to a second aspect of the present invention there is provided a gas turbine engine comprising a bladed rotor assembly according to any one of claims 1 to 8.

Other aspects of the invention provide devices, methods and systems which include and/or implement some or all of the actions described herein. The illustrative aspects of the invention are designed to solve one or more of the problems herein described and/or one or more other problems not discussed.

BRIEF DESCRIPTION OF THE DRAWINGS

There now follows a description of an embodiment of the invention, by way of non-limiting example, with reference being made to the accompanying drawings in which.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION

Figure 1:
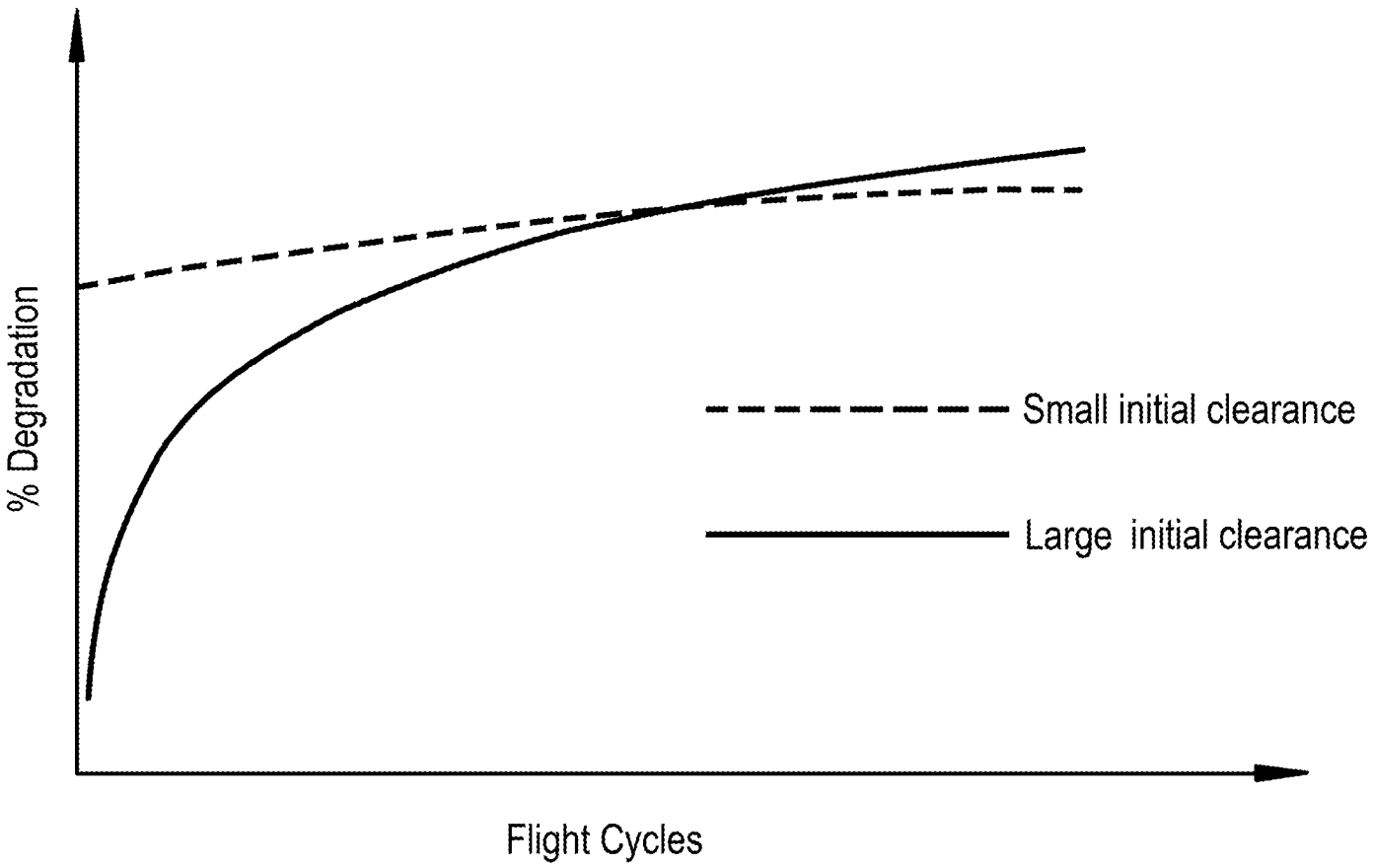
FIG. 1 shows a schematic illustration of the influence of large and small initial fan blade tip clearances on the degradation of gas turbine airflow efficiency according the prior art.
Figure 2:
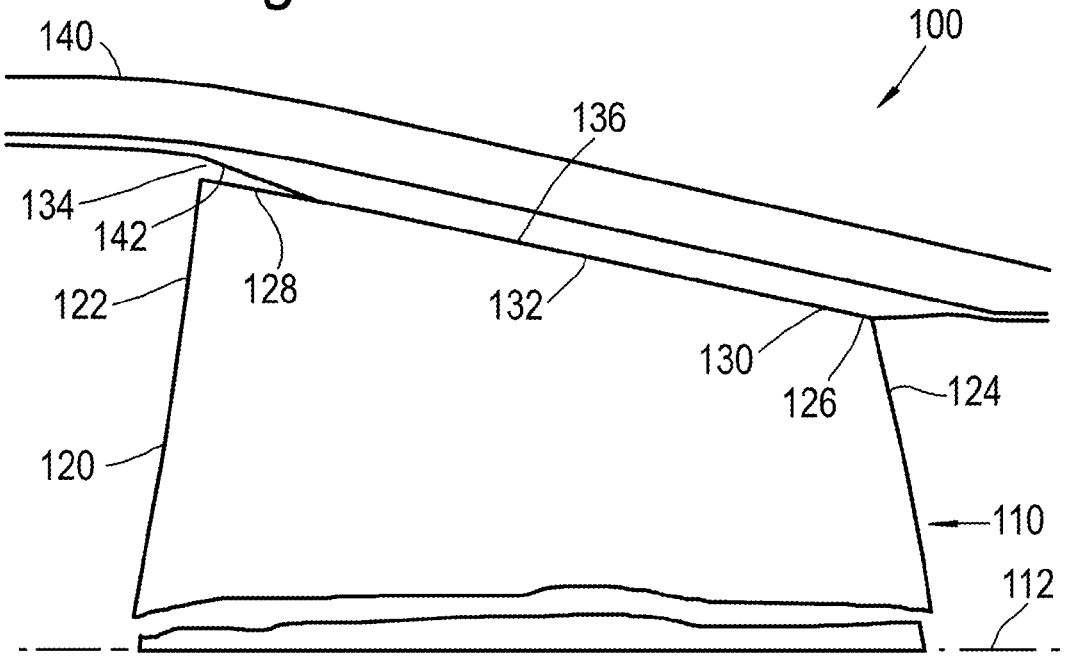
FIG. 2 shows a schematic part sectional view of a bladed rotor assembly according to a first embodiment of the invention.

Referring to FIG. 2, a bladed rotor assembly according to a first embodiment of the invention is designated generally by the reference numeral 100. The bladed rotor assembly 100 comprises a bladed rotor 110 and a rotor housing 140.

The bladed rotor 110 comprises a plurality of blades 120 arranged in a circumferential array around an axis of rotation 112. The rotor housing 140 encircles the bladed rotor 110 and comprises a radially inwardly facing surface 142.

Each of the blades 120 comprises a first radially extending edge 122, an opposite second radially extending edge 124 and a radially distal edge 126. The radially distal edge 126 connects radially distal ends of the first radially extending edge 122 and the second radially extending edge 124.

The radially distal edge 126 of each blade 120 comprises a first end 128, a second end 130 and a centre portion 132. The first end 128 of the radially distal edge 126 adjoins the first radially extending edge 122, while the second end 130 of the radially distal edge 126 adjoins the second radially extending edge 124. The centre portion 132 of the radially distal edge 126 separates the first end 128 from the second end 130.

A clearance between the radially distal edge 126 and the radially inwardly facing surface 142 is a first clearance 134 at the first end 128, and decreases to a second clearance 136 across the centre portion 132.

In the embodiment shown in FIG. 2, the radially distal edge 126 of the blade 120 is substantially lineal while the radially inwardly facing surface 142 is profiled in the axial direction along the axis of rotation 112.

The radially inwardly facing surface 142 is radially separated from the first end 128 of the radially distal edge 126 by the first clearance 134. In the axial direction the radially inwardly facing surface 142 is tapered in a radially inward direction such that at the junction between the first end 128 and the centre portion 132 of the radially distal edge 126, the clearance between the radially distal edge 126 of the blade 120 and the radially inwardly facing surface 142 of the rotor housing 140 has reduced to a second clearance 136. This second clearance 136 is maintained across the length of the centre portion 132, and the remainder of the radially distal edge 126 of the blade 120.

The second clearance 136 is dimensioned such that when the rotor assembly is operating at a predetermined speed and temperature there may be contact between the radially distal edge 126 of the blade 120 and the radially inwardly facing surface 142 of the rotor housing 140.

The transition from the first clearance 134 to the second clearance 136 is a linear transition. In other arrangements, this transition may comprise a nonlinear transition. Alternatively, this transition may comprise two or more linear and/or nonlinear transitions.

In use, as the radially distal edge 126 of the blade 120 sweeps over the radially inwardly facing surface 142 it may contact this surface. In the event of such contact a small amount of material may be abraded away from the radially inwardly facing surface 142.

As a result of the tapered transition between the first clearance 134 and the second clearance 136, the portion of the radially inwardly facing surface 142 adjacent the centre portion 132 extends radially inwardly of the remainder of the radially inwardly facing surface 142. Consequently, as material is abraded from the radially inwardly facing surface 142 the presence of the aforementioned tapered transitions prevents the formation of a radial step around the circumference of the radially inwardly facing surface 142 with the consequential increase in aerodynamic losses and loss of efficiency.

Figure 3:
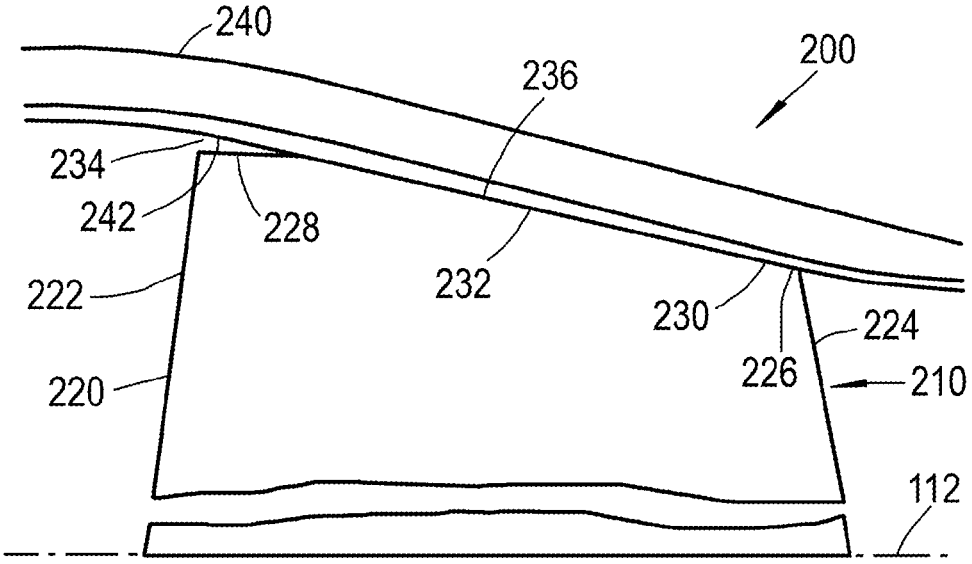
FIG. 3 shows a schematic part sectional view of a bladed rotor assembly according to a second embodiment of the invention.

Referring to FIG. 3, a bladed rotor assembly according to a second embodiment of the invention is designated generally by the reference numeral 200. Features of the bladed rotor assembly 200 which correspond to those of bladed rotor assembly 100 have been given corresponding reference numerals for ease of reference.

The bladed rotor assembly 200 has a bladed rotor 210 and a rotor housing 240.

As described above for the first embodiment, the bladed rotor 210 comprises a plurality of blades 220 arranged in a circumferential array around an axis of rotation 112. The rotor housing 240 encircles the bladed rotor 210 and comprises a radially inwardly facing surface 242.

Each of the blades 220 comprises a first radially extending edge 222, an opposite second radially extending edge 224 and a radially distal edge 226. The radially distal edge 226 connects radially distal ends of the first radially extending edge 222 and the second radially extending edge 224.

The geometry of the blades 220 corresponds to that of the blades 120 of the first embodiment with a radially distal edge 226 of each blade 220 comprising a first end 228, a second end 230 and a centre portion 232. The first end 228 of the radially distal edge 226 adjoins the first radially extending edge 222, while the second end 230 of the radially distal edge 226 adjoins the second radially extending edge 224. The centre portion 232 of the radially distal edge 226 separates the first end 228 from the second end 230.

As with the first embodiment, the clearance between the radially distal edge 226 and the radially inwardly facing surface 242 is a first clearance 234 at the first end 228, and decreases to a second clearance 236 across the centre portion 232.

In this embodiment (shown in FIG. 3) the radially inwardly facing surface 242 remains substantially lineal, while the radially distal edge 226 of the blade 220 is profiled in the axial direction, along the axis of rotation 112.

The radially inwardly facing surface 242 is radially separated from the first end 228 of the radially distal edge 226 by the first clearance 234. In the axial direction the radially distal edge 226 is tapered in a radially outward direction such that at the end of the first end 228 and the start of the centre portion 232 of the radially distal edge 226, the clearance between the radially distal edge 226 of the blade 220 and the radially inwardly facing surface 242 of the rotor housing 240 has reduced to a second clearance 236. This second clearance 236 is maintained across the length of the centre portion 232, and the remainder of the radially distal edge 126 of the blade 120.

In the same way as for the first embodiment, the second clearance 236 is dimensioned such that when the rotor assembly is operating at a predetermined speed and temperature there may be contact between the radially distal edge 226 of the blade 220 and the radially inwardly facing surface 242 of the rotor housing 240.

The transition from the first clearance 234 to the second clearance 236 is a linear transition. In other arrangements, this transition may comprise a nonlinear transition. Alternatively, this transition may comprise two or more linear and/or nonlinear transitions.

In use the bladed rotor assembly 200 according to the second embodiment operates in the same manner as the bladed rotor assembly 100 of the first embodiment described above.

Figure 4:
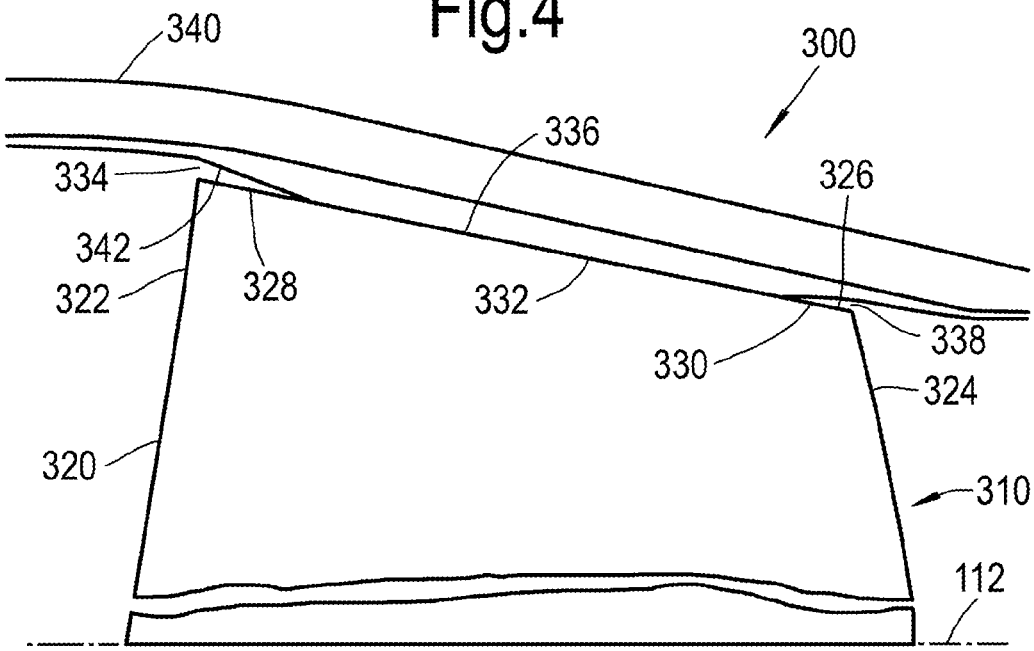
FIG. 4 shows a schematic part sectional view of a bladed rotor assembly according to a third embodiment of the invention.

Referring to FIG. 4, a bladed rotor assembly according to a third embodiment of the invention is designated generally by the reference numeral 300. Features of the bladed rotor assembly 300 which correspond to those of bladed rotor assembly 100 have been given corresponding reference numerals for ease of reference.

The bladed rotor assembly 300 comprises a bladed rotor 310 and a rotor housing 340.

The bladed rotor 310 comprises a plurality of blades 320 arranged in a circumferential array around an axis of rotation 112. The rotor housing 340 encircles the bladed rotor 310 and comprises a radially inwardly facing surface 342.

Each of the blades 320 comprises a first radially extending edge 322, an opposite second radially extending edge 324 and a radially distal edge 326. The radially distal edge 326 connects radially distal ends of the first radially extending edge 322 and the second radially extending edge 324.

The radially distal edge 326 of each blade 320 comprises a first end 328, a second end 330 and a centre portion 332. The first end 328 of the radially distal edge 326 adjoins the first radially extending edge 322, while the second end 330 of the radially distal edge 326 adjoins the second radially extending edge 324. The centre portion 332 of the radially distal edge 326 separates the first end 328 from the second end 330.

A clearance between the radially distal edge 326 and the radially inwardly facing surface 342 is a first clearance 334 at the first end 328, decreases to a second clearance 336 across the centre portion 332, and increases to a third clearance 338 at the second end 330.

In the third embodiment (shown in FIG. 4) the radially distal edge 326 of the blade 320 is substantially lineal while the radially inwardly facing surface 342 is profiled in the axial direction along the axis of rotation 112.

The radially inwardly facing surface 342 is radially separated from the first end 328 of the radially distal edge 326 by the first clearance 334. In the axial direction the radially inwardly facing surface 342 is tapered in a radially inward direction such that at the end of the first end 328 and the start of the centre portion 332 of the radially distal edge 326, the clearance between the radially distal edge 326 of the blade 320 and the radially inwardly facing surface 342 of the rotor housing 340 has reduced to a second clearance 336. This second clearance 336 is maintained across the length of the centre portion 332.

Extending further in the axial direction, the radially inwardly facing surface 342 is tapered in a radially outward direction such that at the end of the second end 330 of the radially distal edge 326, the clearance between the radially distal edge 326 of the blade 320 and the radially inwardly facing surface 342 of the rotor housing 340 has increased to a third clearance 338.

The second clearance 336 is dimensioned such that when the rotor assembly is operating at a predetermined speed and temperature there may be contact between the radially distal edge 326 of the blade 320 and the radially inwardly facing surface 342 of the rotor housing 340.

In the third embodiment the first clearance 334 is greater than the third clearance 338. In other arrangements, the first clearance 334 and the third clearance 338 may be equal to one another. Alternatively, the first clearance 334 may be smaller than the third clearance 338.

The transition from the first clearance 334 to the second clearance 336 is a linear transition. In other arrangements, this transition may comprise a nonlinear transition. Alternatively, this transition may comprise two or more linear and/or nonlinear transitions.

In the third embodiment the transition from the second clearance 336 to the third clearance 338 comprises a linear transition. In other arrangements, this transition may comprise a nonlinear transition. Alternatively, this transition may comprise two or more linear and/or nonlinear transitions.

In use, as the radially distal edge 326 of the blade 320 sweeps over the radially inwardly facing surface 342 it may contact this surface. In the event of such contact a small amount of material may be abraded away from the radially inwardly facing surface 342.

As a result of the tapered transitions between the first clearance 334 and the second clearance 336, and between the second clearance 336 and the third clearance 338, the portion of the radially inwardly facing surface 342 adjacent the centre portion 332 extends radially inwardly of the remainder of the radially inwardly facing surface 342. Consequently, as material is abraded from the radially inwardly facing surface 342 the presence of the aforementioned tapered transitions prevents the formation of a radial step around the circumference of the radially inwardly facing surface 142 at either of the first end 328 or the second end 330 of the radially distal edge 326, with the consequential increase in aerodynamic losses and loss of efficiency.

Figure 5:
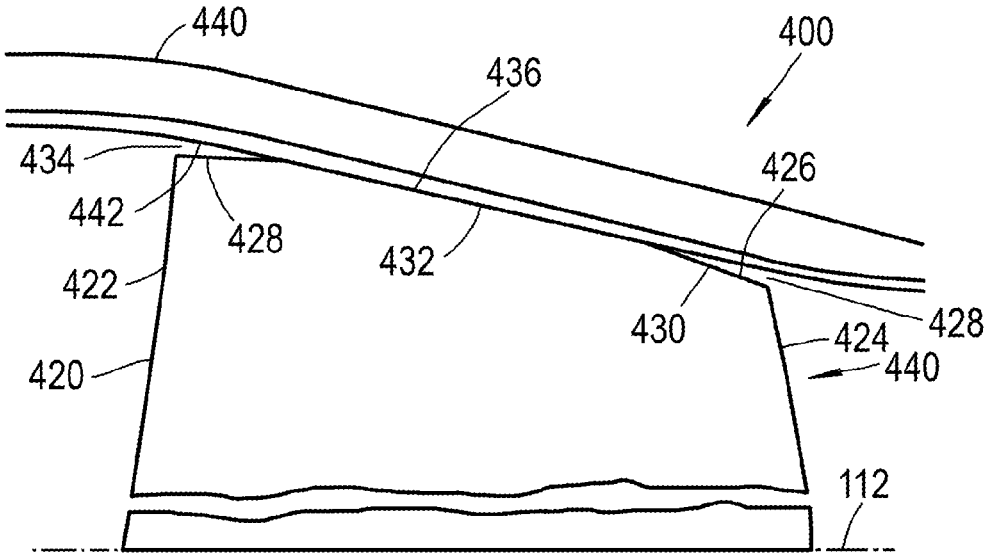
FIG. 5 shows a schematic part sectional view of a bladed rotor assembly according to a fourth embodiment of the invention.
Figure 6:
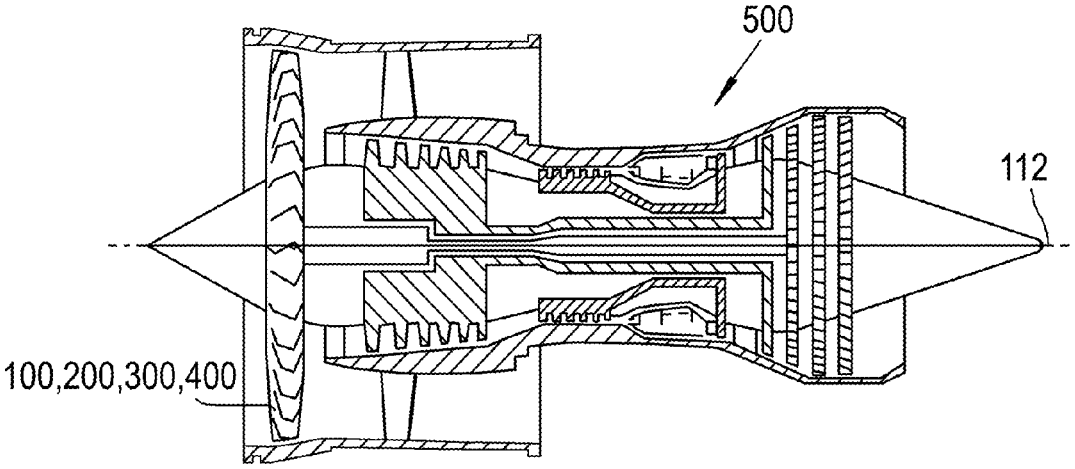
FIG. 6 shows a schematic sectional view of a gas turbine engine comprising a bladed rotor assembly according to an embodiment of the invention.

Referring to FIG. 5, a bladed rotor assembly according to a fourth embodiment of the invention is designated generally by the reference numeral 400. Features of the bladed rotor assembly 400 which correspond to those of bladed rotor assembly 100 have been given corresponding reference numerals for ease of reference.

The bladed rotor assembly 400 has a bladed rotor 410 and a rotor housing 440.

As described above for the first embodiment, the bladed rotor 410 comprises a plurality of blades 420 arranged in a circumferential array around an axis of rotation 112. The rotor housing 440 encircles the bladed rotor 410 and comprises a radially inwardly facing surface 442.

Each of the blades 420 comprises a first radially extending edge 422, an opposite second radially extending edge 424 and a radially distal edge 426. The radially distal edge 426 connects radially distal ends of the first radially extending edge 422 and the second radially extending edge 424.

The geometry of the blades 420 corresponds broadly to that of the blades 120 of the previous embodiments with a radially distal edge 426 of each blade 420 comprising a first end 428, a second end 430 and a centre portion 432. The first end 428 of the radially distal edge 426 adjoins the first radially extending edge 422, while the second end 430 of the radially distal edge 426 adjoins the second radially extending edge 424. The centre portion 432 of the radially distal edge 426 separates the first end 228 from the second end 230.

As with the third embodiment described above, the clearance between the radially distal edge 426 and the radially inwardly facing surface 442 is a first clearance 434 at the first end 428, decreases to a second clearance 436 across the centre portion 432, and increases to a third clearance 438 at the second end 430.

In the fourth embodiment (shown in FIG. 5) the radially inwardly facing surface 442 remains substantially lineal, while the radially distal edge 426 of the blade 420 is profiled in the axial direction, along the axis of rotation 112.

The radially inwardly facing surface 442 is radially separated from the first end 428 of the radially distal edge 426 by the first clearance 434. In the axial direction the radially distal edge 426 is tapered in a radially outward direction such that at the end of the first end 428 and the start of the centre portion 432 of the radially distal edge 426, the clearance between the radially distal edge 426 of the blade 420 and the radially inwardly facing surface 442 of the rotor housing 440 has reduced to a second clearance 436. This second clearance 436 is maintained across the length of the centre portion 432.

Extending further in the axial direction, the radially distal edge 426 is tapered in a radially inward direction such that at the end of the second end 430 of the radially distal edge 426, the clearance between the radially distal edge 426 of the blade 420 and the radially inwardly facing surface 442 of the rotor housing 440 has increased to a third clearance 438.

In the same way as for the third embodiment, the second clearance 436 is dimensioned such that when the rotor assembly is operating at a predetermined speed and temperature there may be contact between the radially distal edge 426 of the blade 420 and the radially inwardly facing surface 442 of the rotor housing 440.

In this fourth embodiment the first clearance 434 is equal to the third clearance 438. In other arrangements, the first clearance 434 and the third clearance 438 may be unequal to one another.

The transition from the first clearance 434 to the second clearance 436 is a linear transition. In other arrangements, this transition may comprise a nonlinear transition. Alternatively, this transition may comprise two or more linear and/or nonlinear transitions.

In use the bladed rotor assembly 400 according to the fourth embodiment operates in the same manner as the bladed rotor assembly 300 of the third embodiment described above.

In the third and fourth embodiments described above, the first and third clearances are provided either by profiling of the inwardly facing surface of the rotor housing or by profiling of the radially distal edge of the blade. It is to be understood that in further embodiments of the invention (not shown) the first clearance may be provided by profiling of the inwardly facing surface of the rotor housing while the third clearance may be provided by profiling of the radially distal edge of the blade, or vice versa.

FIG. 4 shows a schematic cross-sectional view of a gas turbine engine 300 comprising a bladed rotor assembly 100;200 according to the invention.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person of skill in the art are included within the scope of the invention as defined by the accompanying claims.

What is claimed is:

1. A bladed rotor assembly comprising:

a bladed rotor having a plurality of blades arranged in a circumferential array around an axis of rotation; and a rotor housing encircling the bladed rotor, the housing having a radially inwardly facing surface;

each of the blades comprising:

a first, radially extending, edge;

a second opposite, radially extending, edge; and a radially distal edge;

the radially distal edge having a first end, a second end, and a center portion, the first end adjoining the first, radially extending, edge, and the second end adjoining the second, radially extending, edge;

wherein a clearance between the radially distal edge and the radially inwardly facing surface is a first clearance at the first end, and decreases to a second clearance across the center portion, and wherein the radially inwardly facing surface is substantially lineal in an axial direction, and the radially distal edge is profiled in a direction from the first end to the second end.

2. The bladed rotor assembly as claimed in claim 1, wherein the clearance between the radially distal edge and the radially inwardly facing surface is the first clearance at the first end, decreases to the second clearance across the center portion, and increases to a third clearance at the second end.

3. The bladed rotor assembly as claimed in claim 1, wherein the transition from the first clearance to the second clearance is a monotonic decrease.

4. The bladed rotor assembly as claimed in claim 2, wherein the transition from the second clearance to the third clearance is a monotonic increase.

5. The bladed rotor assembly as claimed in claim 1, wherein the transition from the first clearance to the second clearance is a nonlinear decrease.

6. The bladed rotor assembly as claimed in claim 2, wherein the transition from the second clearance to the third clearance is a nonlinear increase.

7. The bladed rotor assembly as claimed in claim 1, wherein the radially inwardly facing surface is formed from an abradable material.

8. A gas turbine engine comprising the bladed rotor assembly according to claim 1.

9. The bladed rotor assembly as claimed in claim 1, wherein the first, radially extending, edge is spaced apart from the second, radially extending, edge in the axial direction.

* * * * *